United States Patent [19]

Minneman

[11] Patent Number: 4,811,836

[45] Date of Patent: Mar. 14, 1989

[54] ADAPTABLE CARTRIDGE CONTAINER

[75] Inventor: William J. Minneman, Clayton, Ohio

[73] Assignee: MTM Molded Products Company, Dayton, Ohio

[21] Appl. No.: 190,842

[22] Filed: May 6, 1988

[51] Int. Cl.[4] ..... F42B 37/00; F42B 39/00

[52] U.S. Cl. ..... 206/3

[58] Field of Search ..... 206/3, 443; 220/21, 220/20; 217/18; 224/239

[56] References Cited

U.S. PATENT DOCUMENTS 3,593,873 7/1971 Vonk ..... 206/3 X 3,616,976 11/1971 Geretschlaeger ..... 206/3 X

*Primary Examiner*—William Price

*Attorney, Agent, or Firm*—Biebel, French & Nauman

[57] ABSTRACT

An adaptable cartridge container for receiving a plurality of cartridges of one of a plurality of calibers comprises a housing having a generally rectangular floor and four surrounding sidewalls. A cartridge support shelf is sized to be received within the housing adjacent its floor and includes first projections on one side of the shelf for supporting the shelf at a first height above the floor and second projections on the opposite side of the shelf for supporting the shelf at a second height above the floor. Two ammunition trays also sized to be received within the housing, include a plurality of apertures and downwardly descending sleeves to receive cartridges therein. The container is adapted to receive a wide variety of cartridge calibers by inserting the cartridge support shelf into the housing such that it is supported at either the first or second height above the floor followed by insertion of a selected one of the ammunition trays. The selection of the height of the cartridge support shelf and the ammunition tray are made to accommodate the caliber of cartridges to be received within the container.

11 Claims, 3 Drawing Sheets

ADAPTABLE CARTRIDGE CONTAINER

BACKGROUND OF THE INVENTION

The present invention relates generally to a container for receiving a plurality of cartridges and, more particularly, to such a container that can be adapted to receive cartridges of one of a plurality of calibers.

Currently used firearms come in a wide variety of calibers. While "caliber", strictly speaking, defines the diameter of the bore of a gun or a bullet which is to pass therethrough, the cartridges for the various caliber firearms vary not only in diameter but also in length. While cartridges can be stored and carried in the original boxes in which they are purchased, such boxes are typically made of cardboard which cannot withstand moisture or the stress of repeated handling which is common in the case of many cartridges which are reloaded by users of the associated firearms.

To overcome these problems, durable containers made of metals and plastics have been produced. See for example U.S. Pat. Nos. 3,923,152 and 4,467,947 which illustrate two varieties of cartridge containers. Unfortunately, known prior art cartridge containers can accommodate only a single caliber of cartridges or at most two or three various but often related cartridge calibers. Thus, a large variety of such containers must be produced resulting in increased manufacturing expenses as well as large inventories to accommodate users of a large variety of firearm calibers.

What is needed, therefore, is a cartridge container which can be adapted to receive a plurality of cartridges of one of a plurality of calibers. Such an adaptable cartridge container is particularly advantageous for incorporation into a gun case or the like which can receive firearms having a wide variety of calibers.

SUMMARY OF THE INVENTION

The problems of the prior art, wherein cartridge containers are capable of receiving only one or a limited number of cartridge calibers, has been overcome by an adaptable cartridge container in accordance with the present invention which receives a plurality of cartridges of one of a plurality of calibers. The adaptable cartridge container comprises a housing having a floor and surrounding sidewall with the floor preferably being rectangular such that there are four sidewalls. A cartridge supporting shelf is positioned at one of at least two heights above the floor of the container. To complete the cartridge container, one of at least two ammunition trays, each including a plurality of apertures for defining an apertured top surface for the container, is inserted into the top of the housing over the cartridge support shelf. Selection of the height of the cartridge support shelf and the ammunition tray used are made to accommodate the caliber of cartridges to be received within the container such that the nose or bullet end of the cartridges rests against the cartridge support shelf with the cartridges received within the apertures of the selected ammunition tray and extending slightly thereabove such that the bases of the cartridges are accessible for easy removal from the container.

In accordance with one aspect of the present invention, an adaptable cartridge container for receiving a plurality of cartridges of one of a plurality of calibers comprises a housing having a floor and surrounding sidewall. A cartridge support shelf which is sized to be received within the housing adjacent its floor includes elevation control means for supporting the shelf at one of at least two heights above the floor. At least two ammunition trays which also are sized to be received within the housing are formed to include a plurality of apertures for defining an apertured top surface for the housing. The container is adapted to receive a wide variety of cartridge calibers by inserting the cartridge support shelf into the housing such that it is supported at a selected height above the floor followed by insertion of a selected one of the ammunition trays. The selection of the height of the cartridge support shelf and the ammunition tray are made to accommodate the caliber of cartridges to be received within the container.

The elevation control means may comprise projections extending from at least one side of the cartridge support shelf and preferably extending from both sides of the cartridge support shelf such that the shelf may be supported at a first height corresponding to the height of first projections on one side of the shelf or at a second height corresponding to second projections on the opposite side of the shelf. Each of the ammunition trays may include cartridge receiving sleeves extending downwardly from the top surface of the trays and centered around the plurality of apertures with the sleeves being formed to receive the projections on the cartridge support shelf between adjacent sleeves when the shelf is inserted into the housing with projections extending upwardly and one of the trays is then inserted into the housing.

Preferably, the adaptable cartridge container may further comprise retaining means formed into the sidewall, or into at least two of the sidewalls for a rectangular container, for supporting the selected ammunition tray in the housing. The adaptable cartridge container of the present invention is preferably formed of plastic material which can tolerate water and other adverse conditions and provide longevity beyond that of the brass casings of the cartridges to be received within the container.

It is a primary object of the present invention to provide an adaptable cartridge container for receiving a plurality of cartridges of one of a plurality of calibers by means of a cartridge support shelf including elevation control means for supporting the shelf at one of at least two heights above the floor of a housing and at least two ammunition trays sized to be received within the housing and including a plurality of apertures for receiving cartridges therein with the height of the shelf and the tray being selected in accordance with the caliber of the cartridges to be supported such that the noses of the cartridges rest upon the shelf while the bases of the cartridges extend above the upper surface of the ammunition tray selected to provide easy access to the cartridges within the adaptable cartridge container.

Other objections and advantages of the invention will be apparent from the following description, the accompanying drawings, and the appended claims.

DETAILED DESCRIPTION OF THE INVENTION

Figure 1:
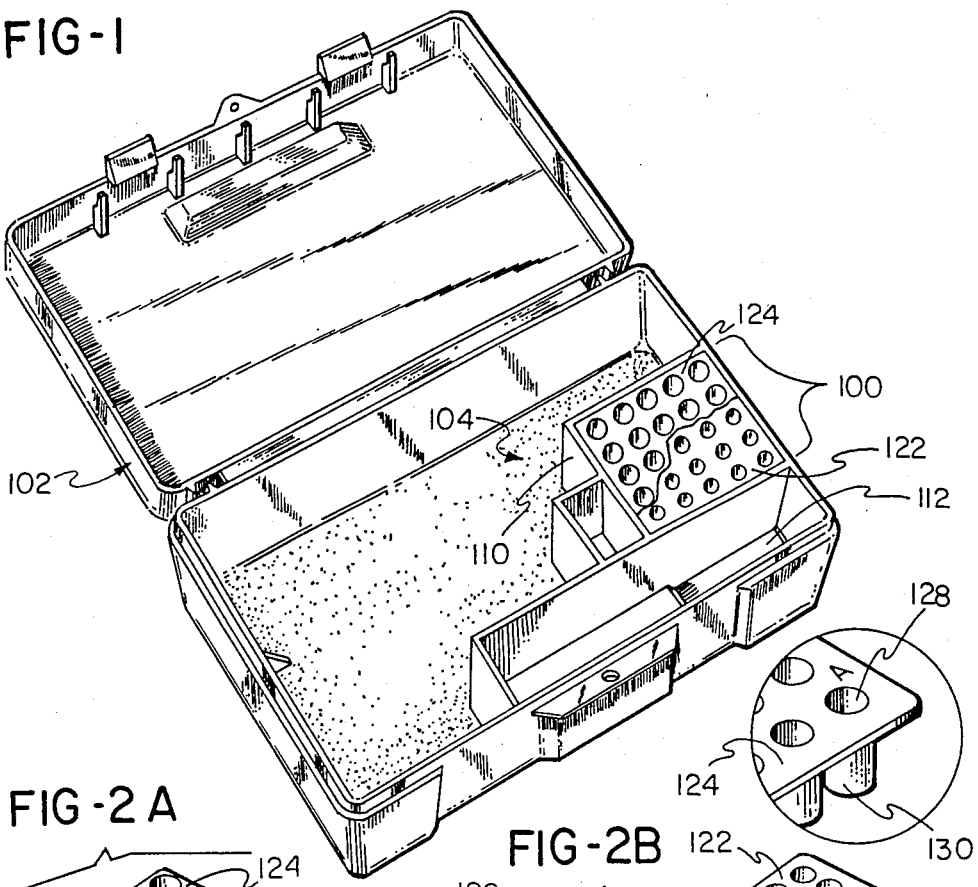
FIG. 1 is perspective view of a handgun case incorporating an adaptable cartridge container in accordance the present invention showing a composite of two different ammunition trays.

An illustrated embodiment of an adaptable cartridge container 100 in accordance with the present invention will now be described with reference to the drawing figures. While the adaptable cartridge container 100 of the present invention can be constructed as a stand alone container including a removable or hinged cover, it is particularly applicable for inclusion in a firearm case and accordingly is shown in FIG. 1 as being incorporated into a handgun storage case 102 which is the subject of a pending patent application entitled HANDGUN STORAGE BOX (MTM 008 D2) which was filed on even date herewith and is assigned to the assignee of the present application.

Figure 2A:
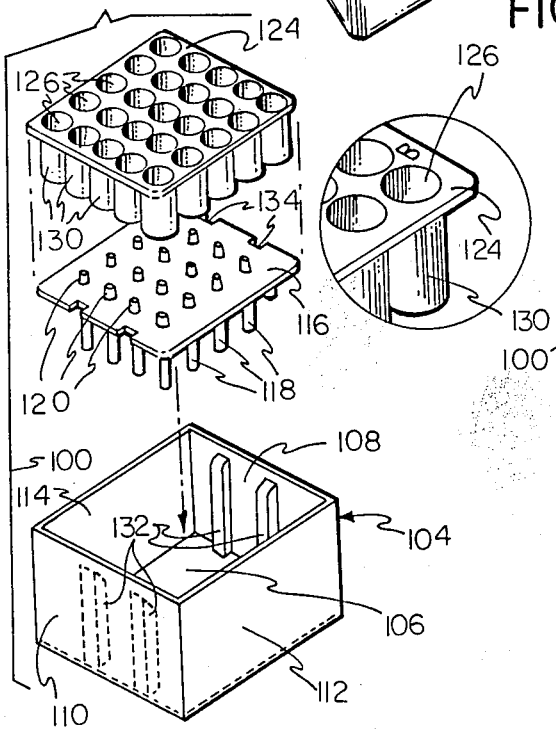
FIGS. 2A and 2B are exploded views showing two possible configurations of the adaptable cartridge container of the present invention.
Figure 2B:
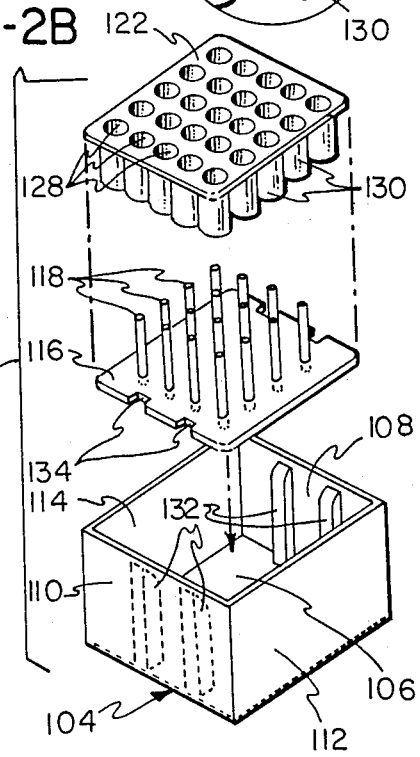
Figure 6:
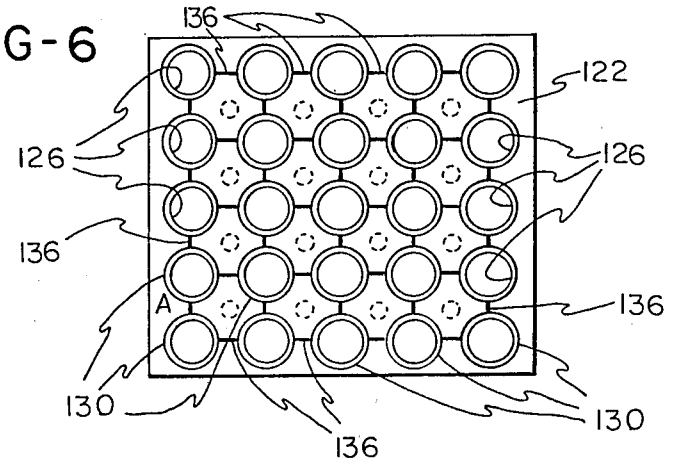
FIG. 6 is a bottom plan view of an ammunition tray designated "A", also see FIG. 2B.

Exploded views of the adaptable cartridge container 100 illustrating two possible configurations of the container 100 are shown in FIGS. 2A and 2B. The adaptable cartridge container 100 comprises a housing 104 having a floor 106 and surrounding sidewall. A shown in the illustrated embodiment, the housing 104, and hence the floor 106, is rectangular (approximately 68 mm ×77 mm) such that there are four sidewalls 108, 110, 112 and 114, of course, the container 100 of the present invention could be made in any desired geometric shape. A cartridge support shelf 116 is sized to be received within the housing 104 adjacent the floor 106. The cartridge support shelf 116 includes elevation control means for supporting the shelf 116 at one of at least two heights above the floor 106.

In the illustrated embodiment, the elevation control means comprises a plurality of projections 118 of a first height extending from one side of the cartridge support shelf 116 and a plurality of projections 120 of a second height extending from the opposite side of the cartridge support shelf 116. The projections 118 are approximately 15 mm in length while the projections 120 are approximately 3 mm in length with the shelf 116 itself being approximately 2 mm in thickness such that cartridges inserted into the container 100 rest upon the cartridge support shelf 116 at a height of approximately 5 mm or 17 mm above the floor 106 of the housing 104. Of course, the shelf 116 could be of a different thickness, the short projections 120 could be eliminated all together, the projections 118, 120 could be of other heights, or other variations could be made in the illustrated embodiment to adjust the elevation means for specific applications of the present invention.

The adaptable cartridge container 100 also includes at least two ammunition trays 122, 124 which are each sized to be received within the housing 104 and include a plurality of apertures for defining an apertured top surface for the housing 104. The ammunition tray 122 (designated Tray A) includes 25 apertures 126 which are approximately 9 mm in diameter, while the ammunition tray 124 (designated Tray B) includes 25 apertures 128 which are approximately 12 mm in diameter.

Preferably the ammunition trays 122, 124 include cartridge receiving sleeves 130 which extend downwardly from the upper surface of the trays 122, 124 and are centered around the apertures 126, 128 formed within the top surface of the ammunition trays 122, 124. Also, the housing 104 of the adaptable cartridge container 100 includes retaining means formed into the sidewall of the housing or, in the case of a rectangular housing 104 as shown in the illustrated embodiment, into at least two of the sidewalls 108, 110, 112 or 114 for supporting the selected ammunition tray 122 or 124 in the housing 104. In the illustrated embodiment, as best shown in FIGS. 2A and 2B, the retaining means comprise a pair of ribs 132 formed and extending on the inner surfaces of the sidewalls 108 and 110.

Figure 7:
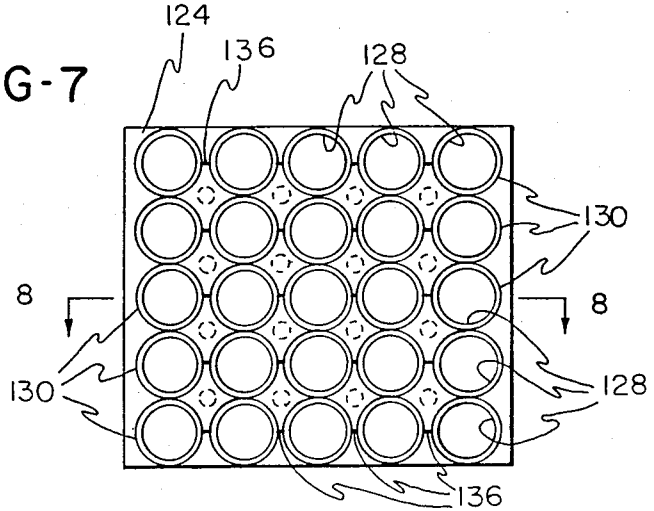
FIG. 7 is a bottom plan view of an ammunition tray designated "B", also see FIG. 2A.
Figure 3:
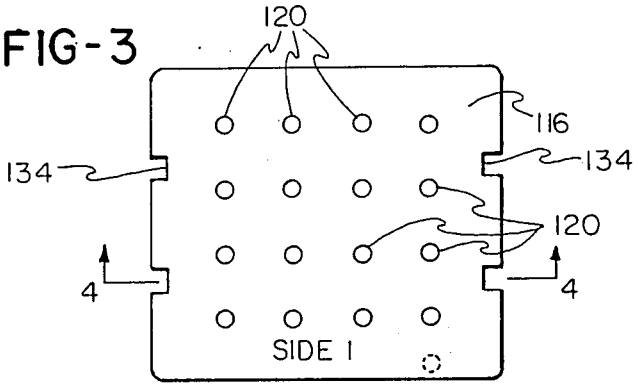
FIG. 3 is a top plan view of a cartridge support shelf of FIG. 2.
Figure 4:
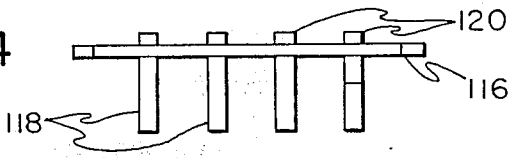
FIG. 4 is a sectional view taken along the section line 4—4 of FIG. 3.
Figure 5:
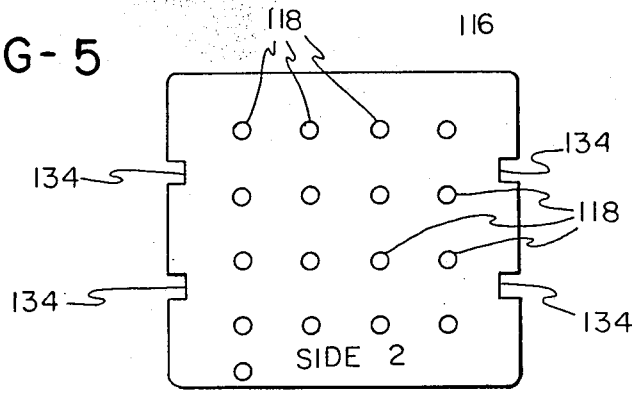
FIG. 5 is a bottom plan view of the cartridge support shelf of FIG. 2.
Figure 8:
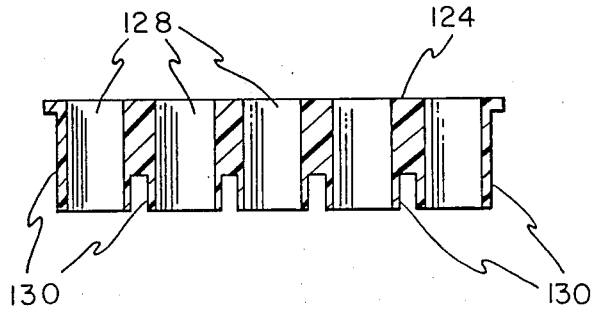
FIG. 8 is a sectional view of a "B" ammunition tray taken along the section line 8—8 of FIG. 7.

Preferably, the trays 122, 124 are sized such that they are supported by the ribs 132 formed into the sidewalls 108, 110 of the housing 104 and also frictionally engage the upper edges of the sidewalls 108–112 to stabilize the adaptable cartridge container 100. Also, the shelf 116 includes notches 134 such that the shelf will fit freely into the housing 104. The sleeves 130 are formed to receive the projections 118 or 120 on the shelf 116 between adjacent sleeves when the shelf 116 and one of the trays 122, 124 are received within the housing 104. This is illustrated in FIGS. 7 and 8 by the phantom line drawings showing where the projections 118 or 120 fit relative to the sleeves 130. Preferably, the sleeves 130 comprise thin plastic sidewalls which are interconnected to adjacent sleeves 130 by means of thin webs 136 such that the open spaces between four adjacent sleeves 130 and their associated webs 136 are left open to receive the projections 118 or 120 therewithin.

Figure 9:
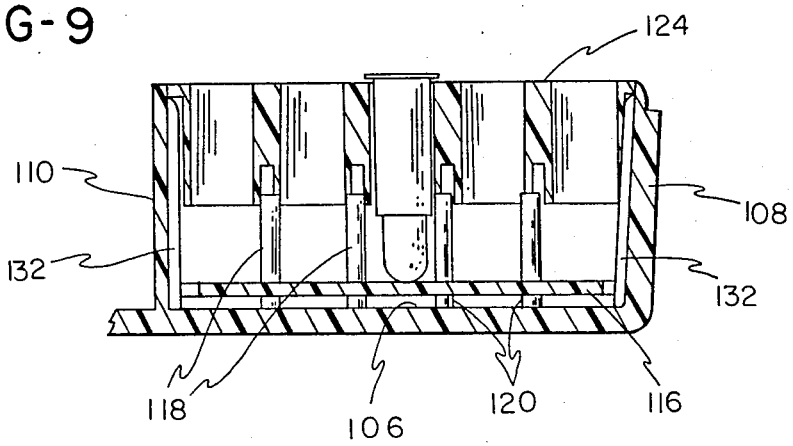
FIGS. 9 and 10 are sectional views showing two of the possible configurations of the illustrated embodiment of the adaptable cartridge container of the present invention.
Figure 10:
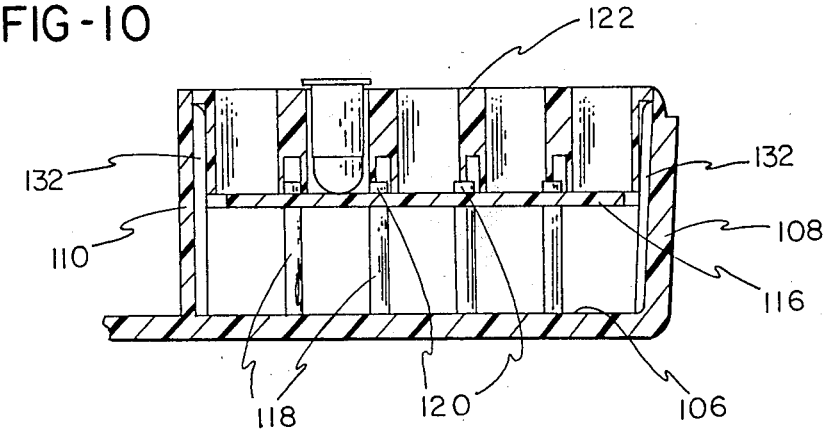

The container 100 can be adapted to receive a wide variety of cartridge calibers by inserting the cartridge support shelf 116 into the housing 104 with the projections 118 supporting the tray 116 at the first height of approximately 17 mm above the floor 106 (see FIG. 10) or the projections 120 supporting the tray 116 at a second height of approximately 5 mm above the floor 106 (see FIG. 9) of the housing 104. Once the cartridge support shelf 116 has been inserted into the housing 104, such that it is supported at the selected height, one of the ammunition trays 122, 124 is inserted into the housing 124 over the cartridge support shelf 116. The selection of the orientation of the cartridge support shelf 116 and hence its height above the floor 106 of the housing 104, and the ammunition tray 122 or 124 are made to accommodate the caliber of cartridges to be received within the container 100. The following wide range of calibers can be accommodated in an adaptable storage container constructed in accordance with the present invention as previously described wherein the height of the side walls 108–112 are approximately 37 mm:

| | TRAY A | TRAY B | SUPPORT SIDE 1 UP | SUPPORT SIDE 2 UP |
|---|---|---|---|---|
| 25 Auto | X | | X | |
| 32 S & W | X | | X | |
| 32 S & W Long | X | | | X |
| 32 Short Colt | X | | X | |
| 32 Long Colt | X | | | X |

-continued

| | TRAY A | TRAY B | SUPPORT SIDE 1 UP | SUPPORT SIDE 2 UP |
|---|---|---|---|---|
| 32 7.65 mm Auto Pistol | X | | X | |
| 9 mm Luger | X | | X | |
| 357 Mag | X | | | X |
| 38 Auto | X | | X | |
| 38 S & W | X | | | X |
| 38 Special | X | | | X |
| 38 Short | X | | X | |
| 38 Long Colt | X | | X | |
| 41 Mag | | X | | X |
| 44 Mag | | X | | X |
| 44 S & W Sp. | | X | | X |
| 45 Colt | | X | | X |
| 45 Auto | | X | X | |
| 45 Auto Rim | | X | X | |

It is apparent that an adaptable cartridge container for receiving a plurality of cartridges of one of a plurality of calibers which is particularly advantageous for incorporation into a gun case or the like has been disclosed. From a review of the forgoing disclosure, alternate embodiments and changes will be apparent to those skilled in the art. For example, alternate elevation control means can be incorporated into the cartridge support shelf and alternate geometric configurations of the container itself may be preferred for particular applications. Accordingly, while the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. An adaptable cartridge container for receiving a plurality of cartridges of one of a plurality of calibers comprising:

a housing having a floor and surrounding sidewall;

a cartridge support shelf sized to be received within said container adjacent said floor and including elevation control means for supporting said shelf at one of at least two heights above said floor; and at least two ammunition trays each sized to be received within said housing and including a plurality of apertures for defining a apertured top surface for said housing, said container being adapted to receive a wide variety of cartridge calibers by inserting said cartridge support shelf into said housing such that it is supported at a selected height above said floor followed by insertion of one of said ammunition trays, the selection of the height of said cartridge support shelf and the ammunition tray being made to accommodate the caliber of cartridges to be received within the container.

2. An adaptable cartridge container for receiving a plurality of cartridges of one of a plurality of calibers as claimed in claim 1 wherein said elevation control means comprises projections extending from at least one side of said cartridge support shelf.

3. An adaptable cartridge container for receiving a plurality of cartridges of one of a plurality of calibers as claimed in claim 2 wherein said at least two ammunition trays include cartridge receiving sleeves extending downwardly from top surface and centered around said plurality of apertures, said sleeves being formed to receive the projections on said shelf therebetween when said shelf is inserted into said housing with said projections extending upwardly and one of said trays is then inserted into said housing thereover.

4. An adaptable cartridge container for receiving a plurality of cartridges of one of a plurality of calibers as claimed in claim 3 further comprising retaining means formed into said sidewall for supporting the selected ammunition tray in said housing.

5. An adaptable cartridge container for receiving a plurality of cartridges of one of a plurality of calibers as claimed in claim 4 wherein said housing, said cartridge support shelf and said at least two ammunition trays are formed of plastic material.

6. An adaptable cartridge container for receiving a plurality of cartridges of one of a plurality of calibers comprising:

a housing having a floor and four surrounding sidewalls;

a cartridge support shelf having a plurality of projections extending from at least one side thereof, said shelf being sized to be received within said container; and at least two ammunition trays each defining an apertured top surface for said housing with cartridge receiving sleeves extending downwardly from said upper surface and centered around apertures formed therein, said trays being sized to be received within said housing with said sleeves being formed to receive the projections on said shelf therebetween when said shelf is inserted into said housing with said projections extending upwardly and one of said trays is inserted into said housing thereover, said container being adapted to receive a wide variety of cartridge calibers by inserting said cartridge support shelf into said housing with the projections supporting said tray or with the projections facing upwardly followed by insertion of one of said ammunition trays, the selection of the orientation of said cartridge support shelf and the ammunition tray being made to accommodate the caliber of cartridges to be received within the container.

7. An adaptable cartridge container for receiving a plurality of cartridges of one of a plurality of calibers as claimed in claim 6 further comprising retaining means formed into at least one of said sidewalls for supporting the selected ammunition tray in s id housing.

8. An adaptable cartridge container for receiving a plurality of cartridges of one of a plurality of calibers as claimed in claim 7 wherein said housing, said cartridge support shelf and said at least two ammunition trays are formed of plastic material.

9. An adaptable cartridge container for receiving a plurality of cartridges of one of a plurality of calibers comprising:

a housing having a floor and four surrounding sidewalls;

a cartridge support shelf having a plurality of projections of a first height extending from one side thereof and a plurality of projections of a second height extending from the opposite side thereof, said shelf being sized to be received within said container; and at least two ammunition trays each defining an apertured top surface for said housing with cartridge receiving sleeves extending downwardly from said upper surface and centered around apertures formed therein, said trays being sized to be received within said housing with said sleeves being formed to receive the projections on said shelf therebetween when said shelf and one of said trays are received within said housing, said container being adapted to receive a wide variety of cartridge calibers by inserting said cartridge support shelf into said housing with the projections of said first height supporting said tray at said first height or the projections of said second height supporting said tray at said second height followed by insertion of one of said ammunition trays, the selection of the orientation of said cartridge support shelf and the ammunition tray being made to accommodate the caliber of cartridges to be received within the container.

10. An adaptable cartridge container for receiving a plurality of cartridges of one of a plurality of calibers as claimed in claim 9 further comprising retaining means formed into at least one of said sidewalls for supporting the selected ammunition tray in said housing.

11. An adaptable cartridge container for receiving a plurality of cartridges of one of a plurality of calibers as claimed in claim 10 wherein said housing, said cartridge support shelf and said at least two ammunition trays are formed of plastic material.

* * * * *